United States Patent [19]

Alworth et al.

[11] Patent Number: 4,626,320

[45] Date of Patent: Dec. 2, 1986

[54] METHOD FOR AUTOMATED DE-COKING

[75] Inventors: Charles W. Alworth, Ponca City, Okla.; Ward B. Davis, Katy, Tex.; John C. Thomas, deceased, late of Ponca City, Okla., by Betty O'Grady Thomas, executor

[73] Assignee: Conoco Inc., Ponca City, Okla.

[21] Appl. No.: 582,619

[22] Filed: Feb. 22, 1984

[51] Int. Cl.[4] ..... C10B 33/00; C10B 41/04

[52] U.S. Cl. ..... 201/2; 202/241

[58] Field of Search ..... 201/1, 2; 202/241, 262, 202/270; 196/122; 134/22.18, 24, 39, 167 R, 113

[56] References Cited

U.S. PATENT DOCUMENTS

| | | | |
|---|---|---|---|
| 2,245,554 | 2/1938 | Court | 134/39 |
| 3,031,169 | 4/1962 | Robinson et al. | 254/173 |
| 3,070,356 | 12/1962 | Buffington | 254/173 |
| 3,280,416 | 10/1966 | Forsyth | 15/104.1 C |
| 3,412,012 | 11/1968 | Patrick et al. | 134/39 |
| 3,759,489 | 9/1973 | Jones | 254/172 |
| 3,836,434 | 9/1974 | Novy | 202/241 |
| 3,880,359 | 4/1975 | Novy | 202/241 |
| 3,892,633 | 7/1975 | Oleszk et al. | 202/241 |
| 4,165,789 | 8/1979 | Roger | 173/9 |
| 4,410,398 | 10/1983 | Chipman et al. | 202/241 |

FOREIGN PATENT DOCUMENTS

| | | | |
|---|---|---|---|
| 56038129 | 9/1979 | Japan | 201/2 |

*Primary Examiner*—Barry S. Richman
*Assistant Examiner*—Joye L. Woodard
*Attorney, Agent, or Firm*—Charles E. Quarton

[57] ABSTRACT

Method for automated hydro-blast de-coking of delayed coke drums wherein programmed central control receives input of drill stem tension, drill bit elevation and drill stem rotation along with indications as to hydraulic hoist power and air pressure input to the drill stem rotary motor, and functions to provide control outputs to automatically control the pilot and main bed cutting procedures attendant an entire drum de-coking operation.

5 Claims, 9 Drawing Figures

METHOD FOR AUTOMATED DE-COKING

BACKGROUND OF THE INVENTION

1. Field Of The Invention

The invention relates generally to removal of petroleum coke from delayed coking drums and, more particularly, but not by way of limitation, it relates to certain programmed automation techniques enabling complete de-coking procedure.

2. Brief Description Of The Prior Art

The cutting of petroleum coke from coke drums has been effected variously for a number of years as this by-product of crude oil refining has a number of valuable applications. It is particularly a practice nowadays to utilize what is known as a delayed coking process wherein residual feedstocks are first heated in a hot furnace and then flowed into a coking drum where the feed is allowed to coke. It has been the prior practice to remove the deposited petroleum coke using various forms of drill bits and particular techniques that have been developed by the system operators. Removal of petroleum coke has become somewhat of an art as the better equipment operators develop certain manual procedures and techniques for hydro-blasting to free the coke product. To Applicant's knowledge, there has been no prior automation approach to removal of petroleum coke from coking drums. U.S. Pat. No. 3,892,633 teaches a vibration detector that provides sound monitoring for the operator's information as well as for controlling certain cutting nozzle movements. This device amplifies sounds of the falling cut coke to provide an indication for the operator as to particle size, efficient cutting, etc.

U.S. Pat. No. 3,880,359 entitled "Apparatus For De-Coking A Delayed Coker" provides prior teaching of hydraulic drilling or cutting apparatus and a specific clean-out procedure relative to the coking drum. Thus, the patent teaches a variation on the standard procedure of first forming an axial pilot hole and then following with an enlarged bit or cutter diameter to successfully ream out greater volumes of petroleum coke along the axial bore until, finally, the drum walls are clean. U.S. Pat. No. 3,280,416 discloses yet another form of de-coking mechanism which utilizes a purely mechanical drill and line conveyor assembly for reaming out the de-coker drums.

Prior teachings have been found for apparatus for automatically controlling the weight on a rotary drilling bit, e.g., U.S. Pat. No. 3,759,489 in the name of Jones. This patent teaches the control of bit weight in a wellbore in the oil well drilling practice. Other U.S. Pat, Nos. 3,070,356; 3,031,169; and 4,165,789 teach similar bit weight control schemes. In particular, the U.S. Pat. No. 4,165,789 provides microcomputer apparatus for tracking selected variables thereby to provide an optimized rate of penetration of a drill into a given medium. This automation technique deals with a drill bit of the type where the bit is maintained in contact with the medium as with mine roof drilling machines for placement of roof bolts and the like.

SUMMARY OF THE INVENTION

The present invention relates to method and apparatus for automated control of coke drum hydraulic de-coking. The apparatus senses drill stem rate of rotation, drill stem tension, drill stem position and incidental operating parameters for input to a programmable logic controller which then provides control output for all vertical motions of the drill stem inside of the coke drum, including the length of stay at a point, the rate of change of motion, total drill stem travel, drill stem rotation rate, and the like. The programmable controller provides continual output of stem position, stem rotation speed, cable tension, de-coking water pressure, and hydraulic fluid pressure in the hoist drive system, as these values are continually available to the operator of the de-coking system. The system is readily switched between manual and automatic to provide for corrective operations in those exigencies where operative variations occur. Thus, in the automatic mode, the program controls drilling of the pilot hole axially through the bed of coke in the coking drum, and then the subsequent reaming of the pilot hole to necessary diameter for receiving the main cutting head. Thereafter, the main cutting head is controlled through particular vertical bench cut reciprocations to remove coke completely from the inside of the coking drum.

Therefore, it is an object of the present invention to enable a de-coking process that can be carried out in relatively lesser time.

It is also an object of the present invention to provide a de-coking process that is somewhat predictable in operation thereby to enable output of petroleum coke having more consistent size and particality with reduced total production of fines.

It is still further an object of the invention to provide an automatically controlled de-coking procedure that contributes to longer life and higher reliability of the attendant equipment.

Finally, it is an object of the present invention to provide an automated de-coking process that poses reduced operator hazards while producing petroleum coke faster with optimum consistency.

Other objects and advantages of the invention will be evident from the following detailed description when read in conjunction with the accompanying drawings which illustrate the invention.

BRIEF DESCRIPTION OF THE DRAWINGS

FIGS. 4, 5, 6, 7 and 8, taken in succession, are an operational flow diagram of the programmed de-coking automation as carried out in the present invention.

DETAILED DESCRIPTION OF THE INVENTION

Figure 1:
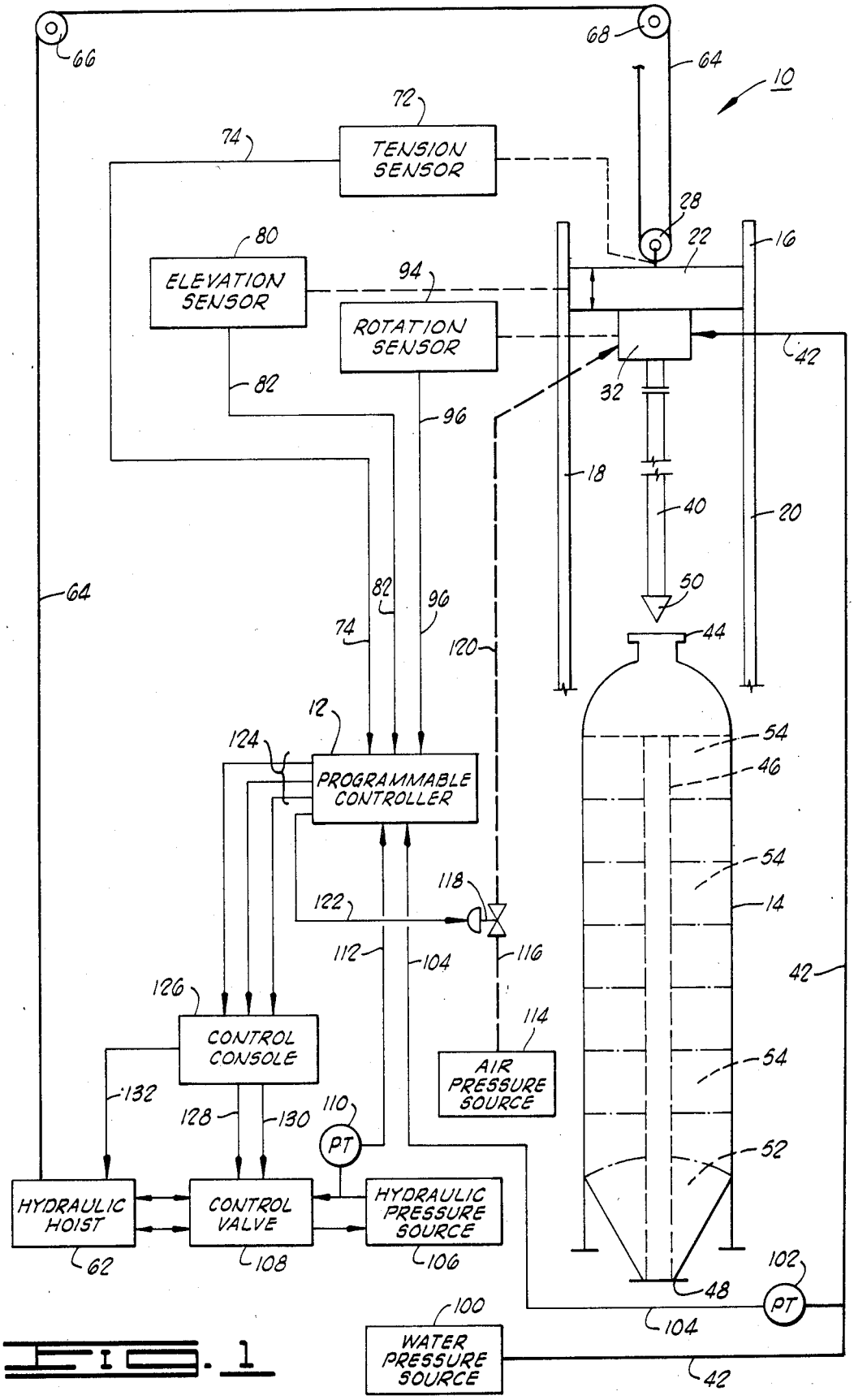
FIG. 1 is a block diagram of an automated de-coking system as constructed in accordance with the present invention.

FIG. 1 illustrates an automated de-coking system 10 as computer circuitry in the form of programmable logic controller 12 functions with a delayed coking drum 14 and associated drilling tower 16. The drum 14 is a well-known refinery structure that is adapted to receive pre-heated crude oil feed stock residuals for cooling and deposition therein. After full deposition of petroleum coke in drum 14, the drill tower 16 is brought into play in hydroblasting the deposited petroleum coke out of drum 14 for further processing.

In the thermal-cracking process, light petroleum ends leave the top of the drum 14 as the heavy ends deposit within the drum as petroleum coke. This coke can take on many grades and usually one of the following three is produced, i.e., soft or fuel grade coke, regular grade coke, and/or premium grade coke. The premium and regular grade cokes are sold to the metals industry for use in the formation of electrodes. Fuel grade coke is used variously but usually mixed with a low grade solid fuel and then utilized in a combustion operation.

Figure 2:
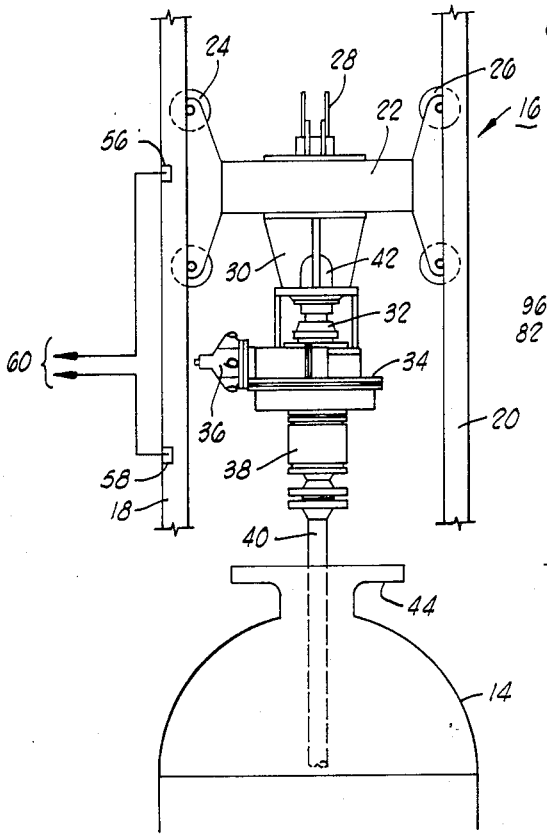
FIG. 2 is a partial view in elevation of a coking tower as employed in the system of FIG. 1.
Figure 3:
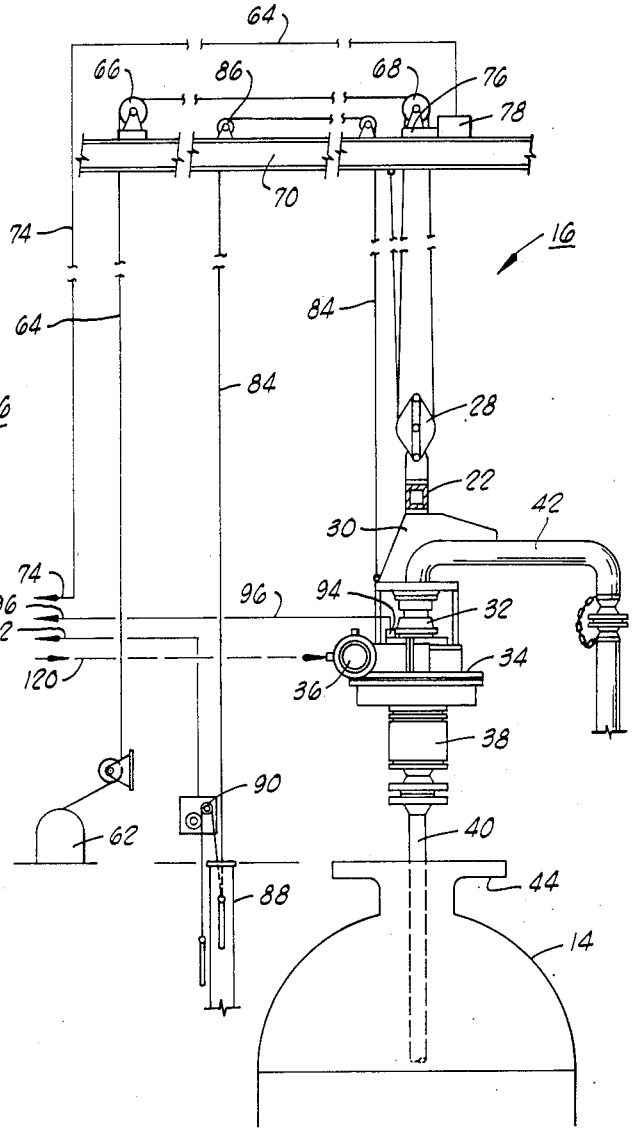
FIG. 3 is a partial side view in elevation of the coking tower of FIG. 2 illustrating the crown block structure.

The drill tower 16 consisting of stanchions or vertical guide rails 18 and 20 stands directly over the coking drum 14 and supports a vertically movable travelling beam 22. Referring also to FIGS. 2 and 3, the travelling beam 22 rides vertically within guide rails 18 and 20 by means of respective guide wheels 24, 26 as vertical movement is imparted through a travelling block 28 pivotally connected to travelling beam 22. A support assembly 30 secured beneath travelling beam 22 supports a rotatable kelly assembly 32 with rotary table 34 as driven by an air motor 36. The rotary table 34 then supports a rotary joint 38 and drill stem 40. Very high pressure hydro-blasting water supply is provided via conduit 42 through kelly assembly 32 and into the rotary drill stem 40 during drilling operation.

The structure as described heretofore is generally state-of-the-art equipment for petroleum coke production as an operator controls the drill stem 40 from a selected vantage point to remove the coke each time the drum 14 is filled. The removal of coke is a two-step process. The first step is to lower the drill stem 40 down through the drum top hatch 44 to drill an axial pilot hole 46 (FIG. 1) from the top of the drum through the coke bed clear to the bottom of the drum or drain hatch 48. Pilot hole 46 is then enlarged or reamed to permit a larger drilling bit 50 to be placed on drill stem 40 for the final clean-out of drum 14. Thus, drill bit 50 may be either the initially used pilot bit or the larger finishing bit although some operations use a single bit for the entire clean-out process. Enlargement of pilot hole 46 also allows removed coke and accumulated blasting water to flow downward therethrough for removal through bottom hatch 48 and subsequent transportation and processing. With the main or larger bit in place, final clean-out entails a series of bench clean-outs taking successive portions such as bottom cone 52 and descending bench portions 54.

Coke removal or "coke knocking" is somewhat of an art and it is very easy to stick a drill stem during the operation. This is particularly true while drilling in the pilot hole without free flow of loosed material downward, and such sticking can result in considerable lost time while the stuck drill stem is freed. In the present invention, the automatic control of the drill stem enables more consistent coke knocking to reduce clean-out time and improve throughput for the coker unit. Thus, in the de-coking procedure, the programmable logic controller 12 is employed to track and control all vertical motions of the drill stem 40 inside coke drum 14, including the length of dwell at a given point, the rate of change of motion, total travel, drill stem rotation, and such related parameters.

As shown in FIG. 2, a pair of spaced limit switches 56 and 58 are disposed in spaced relationship along such a vertical guide rail 18 to provide a safety control when drill stem 40 and drill bit 50 are within the top ten feet of coke drum 14. Thus, limit switch outputs on leads 60 function as an interlock control to main power application. As shown in FIGS. 1 and 3, vertical movement to the drill stem is supplied by a hydraulic hoist 62 controlling a cable 64 led upward over a lead pulley block 66 and crown pulley block 68 for function with travelling block 28. The lead block 66 and crown block 68 are supported on a crown beam 70 as suitably disposed in support across tower structure 16. While a hoist 62 is specified as hydraulic, an air hoist of equivalent rating and air power source may be used in like manner to function fully as well under automatic control.

The drill stem tension or weight of gravity is sensed by a tension sensor 72 functioning at crown block 28 to provide a tension output on a lead 74 for input to programmable controller 12. Referring to FIG. 3, the tension sensor 72 may be such as a load cell 76 connected between crown block 68 and supported structure while providing an output on lead 74 via a transmitter 78. Alternatively, a conventional type of running line tensiometer may be employed. Such tension metering apparatus and signal transmitters as well known in the art and commercially available for such industrial applications. Thus, the load cell output may be processed for transmission by a bridge-input two-wire transmitter type TP640 as commercially available from Action Instruments Co., Inc., of San Diego, Calif.

An elevation sensor 80 is connected to sense the position of travelling beam 22 and therefore drill bit position to provide an output via lead 82 to the programmable controller 12. As shown in FIG. 3, the elevation sensor 80 may be a simple wire line device with a cable 84 running over blocks 86 and downward for counterweighted movement within a pipe casing 88 as an electrical linear motion indication is output from a transmitter 90. The level gauge 90 may be such as the precision level gauge available from FIC Industries of Broomall, Pa., functioning to provide output through a series 2300 two-wire transmitter as commercially available from Rochester Instruments Systems, Inc., of Rochester, N.Y.

Finally, bit rotation is sensed by a rotation sensor 94 in sensing contact with kelly assembly 32 to provide output via lead 96 for input to programmable controller 12. In FIG. 3, rotary speed sensing is effected by counting rotary passage of bolt heads on kelly assembly 32 by using such as a Model SSA-50P rate meter/tachometer (low speed) as it provides direct output on lead 96. The Model SSA-50P is commercially available from Electro-Sensors, Inc., of Minneapolis, Minn.

Water under high pressure, e.g., 2000 psig, is available from a selected water pressure source 100 along conduit 42 for input through the rotary joint of kelly assembly 32 to the drill stem 40 and associated hydraulic drill bit 50. Various forms of commercially available drill bit, both pilot and finishing bits, may be utilized. A pressure transmitter 102 senses water pressure in conduit 42 and transmits a signal indication via line 104 for input to programmable controller 12. The pressure transmitter 102 is a conventional pressure transmitter providing a 4–20 ma signal indication as is commercially available from Fisher Controls Corporation. A hydraulic pressure source 106 functioning with a Moog-type servo-control valve 108 functions to drive the hydraulic hoist 62. A pressure transmitter 110, also a 4–20 ma Fisher-type sensor/transmitter, monitors system hydraulic pressure and provides electrical indication on lead 112 for input to programmable controller 12. An air pressure source 114 provides pressurized air via line 116 through a Fisher-type control valve 118 for input on air line 120 to drive the air motor 36 (FIG. 2) in association with rotary table 34.

Programmable controller 12 receives tension input 74, elevation input 82 and rotation input 96 as well as air and hydraulic pressure inputs 104 and 112, and provides a series of control outputs. Thus, controller 12 provides a control output 122 to control the valve 118 and adjust air pressure on line 120 thereby to control the speed of air motor 36 (FIG. 3). The programmable controller 12 also provides a plurality of control outputs on lines 124 to a control console 126 located at the operator position and accessible to the operator for automated control and manual override. Outputs 128 and 130 from control console 126 provide control of servo-control valve 108 to control hydraulic hoist 62 and adjust speed of movement of cable 64. An output 132 from the control console 126 provides brake control at hydraulic hoist 62.

The programmable logic controller 12 may be such as a Texas Instruments Type PM 550 PLC and including the associated Texas Instrument type digital and analog I/O modules, parallel output modules and power supply. The programmed controller 12 receives input of drill stem position on lead 82, drill rotation speed on lead 96 and cable tension on lead 74 as well as input of de-coking water pressure on lead 104 and hydraulic fluid pressure on lead 112. The controller 12 displays these variables to the de-coke operator and allows the operator to switch between automatic programmed control and manual control where necessary on alarm. Thus, the control console 126 at the operator position provides digital read-out of all necessary operating parameters, as will be further described, as well as manual hoist control, auto/manual control, pilot/main bed control, and all alarm and acknowledgement lamps and actuators.

The programmed logic controller 12 is programmed so that it is capable of drilling the pilot hole through the bed of coke in drum 14, and thereafter reaming the pilot hole to the necessary diameter to pass the main bed cutting bit, and then still reaming the bottom cone; and, the pilot bit is then withdrawn for a change to the main bit and the main bit is sequenced through a series of whittling bench cuts through the final drum clearing procedure as will be further described below. The automated de-coking procedure is illustrated in the flow diagram of FIGS. 4–8 wherein circles designate continuation flags, oval blocks denote statements, rectangular blocks denote automated actions, and trapezic blocks denote operator actions.

Figure 4:
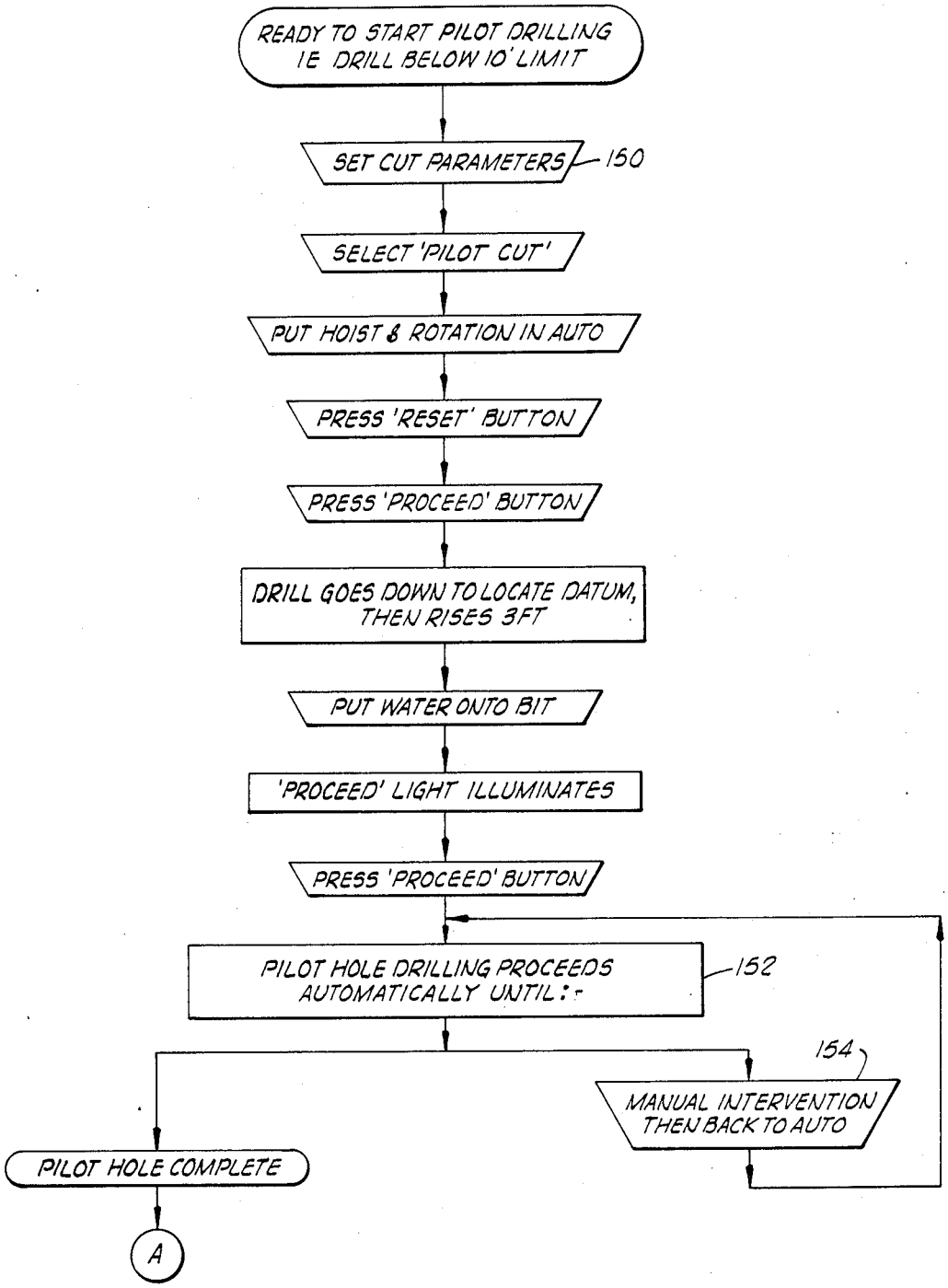

The flow of FIG. 4 illustrates the initial set-up stages wherein the operator sets in the various operational parameters for drilling of the pilot hole 46 and final clean out/bench cut (FIG. 1) axially down through the coke mass and open through bottom hatch 48. The operator first initializes all settings and sets the cut parameters as at flow stage 150. Suggested values for drilling parameters are:

Bench Cut Step Size—8.0 feet
Rotation High Speed—10.0 RPM
Rotation Low Speed—4.0 RPM
Bench Cut Hold Time—3.0 minutes
Vertical Hoist High Speed—30.0 feet per minute
Vertical Hoist Low Speed—10.0 feet per minute The operator then places the program on "pilot cut", places hoist and rotation in automatic and initiates program operation by pressing the PROCEED button. The drill is then lowered to the datum or top of coke whereupon it rises three feet and, thereafter, water pressure is applied to the bit and the program proceeds with pilot hole drilling under automatic control as at stage 152. The program also calculates coke yield upon finding top of datum. The program drills the pilot hole 46 at five feet per minute vertical speed limit until the first time the bit hits coke, i.e., the bit actually advances to the forefront of the water jet and strikes the coke solid so that the tension drops below the threshold limit of 800 units. The first time the drill bit 50 experiences "hit coke", the program automatically imposes a new vertical speed limit of three feet per minute. The "hit coke" function reduces the vertical speed until the cable tension threshold limit is satisfied and then starts to increase the vertical speed of descent of bit 50 up to the reduced speed limit.

For a particular case, a 109-foot tall coking drum 14 is specified, when the drill bit 50 reaches the 85-foot position, the program automatically imposes a new vertical speed limit of two feet per minute upon a "hit coke" condition. Drilling proceeds at this rate as long as rotation speed condition and cable tension threshold limits are satisfied. If the necessary conditions are not satisfied within a reasonable length of time, the operator may switch to manual as at stage 154 to correct the hole condition for a return to automatic programmed control. If the drill stem hits coke as it returns to the point of departure, the program will re-drill the pilot hole subject to the same vertical and rotation constraints as at the hit coke time; and, if drill bit 50 does not hit coke as it returns to the point of departure, it will move directly to the point of departure and then resume pilot drilling subject to the same constraints that were in effect at that point.

At any time, if you "Hit Coke" and have a low rotational speed, e.g. below 75% of low rotational speed, the drill stem raises a selected distance, e.g. ½–2 ft., and is held there until the rotary speed again exceeds 85% of low rotational speed as the program delays for fifteen seconds. Then, the drill is advanced into the hole at 5 feet per minute. This occurs above and below the 85 foot level and the step cannot repeat until the drill stem proceeds below the position previously occupied at "Hit Coke". The various parameter tolerances may be preselected by the operator.

An alarm light on the control console 126 comes on at the 104-foot level, five feet from bottom, to remind the operator to listen and/or watch for breakthrough of the pilot drilling sequence as material falls from bottom hatch 48. If drilling water pressure on line 42 falls below 2000 psig at any time during the pilot hole drilling, an alarm light and audible alarm will be made and the program holds drill stem position. When drilling water pressure is regained, a green PROCEED light indicates pilot drilling resumption as the operator pushes the PROCEED button.

Figure 5:
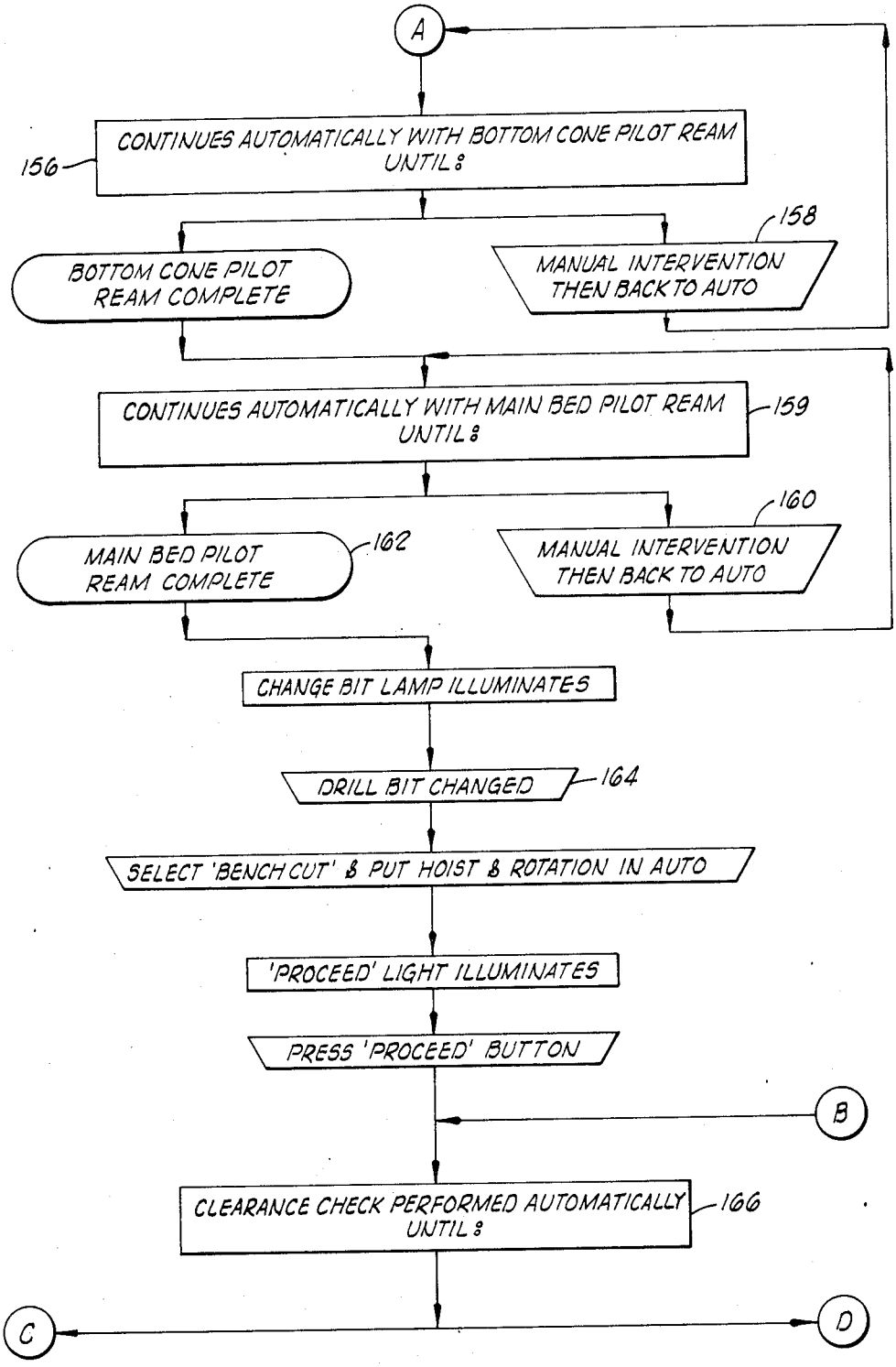
Figure 7:
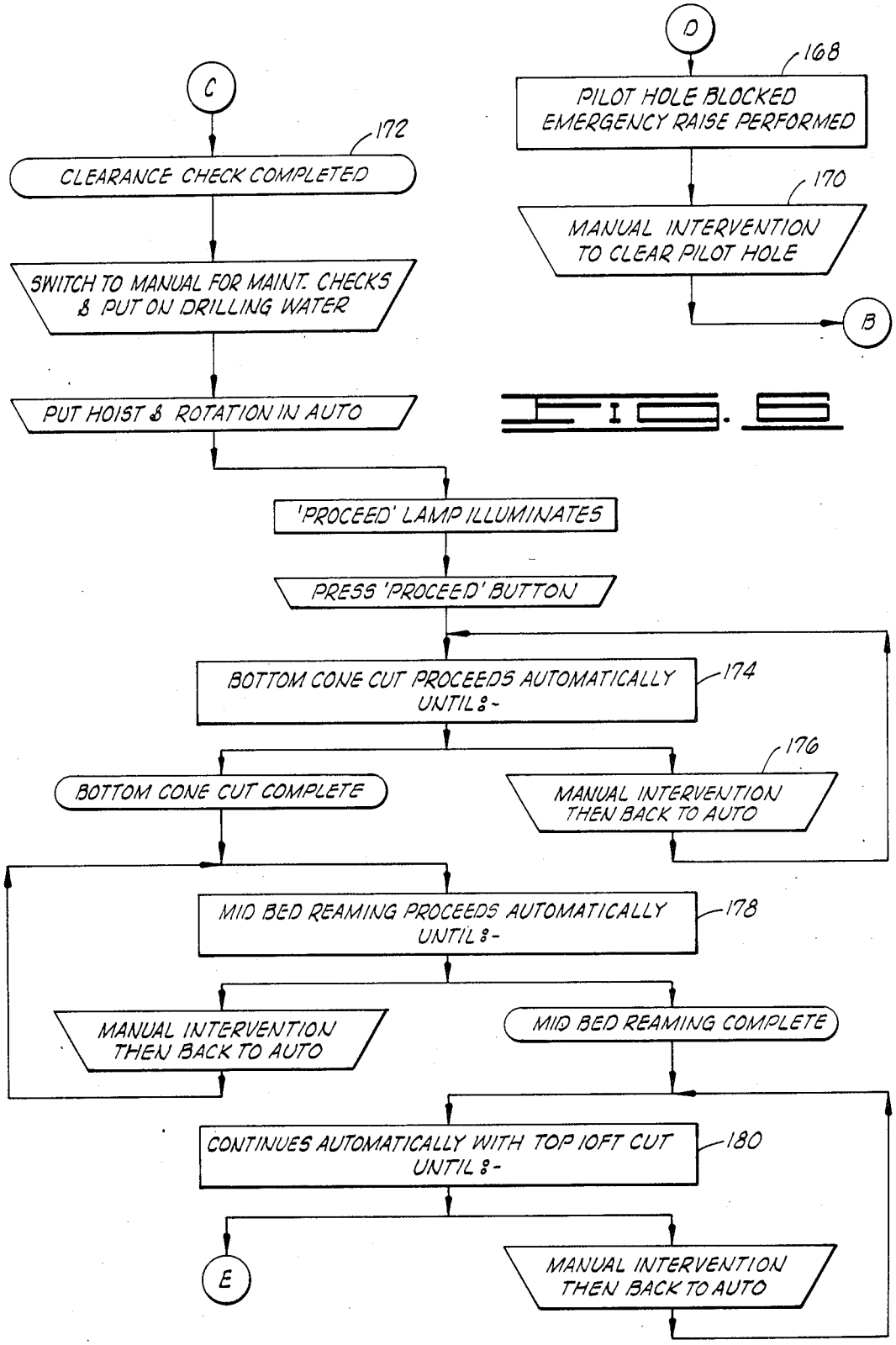

With the pilot hole complete, the program proceeds via continuation A to the flow of FIG. 5 and reaming of the pilot hole. Thus, as at flow stage 156, the program immediately starts the bottom cone reaming sequence as it raises the drill bit 50 fifteen feet with subsequent lowering by fifteen feet at low vertical speed and average rotational speed. The program then starts the full or main bed reaming sequence at stage 159 as it raises the drill bit 50 to the top or datum level and then returns it to the 104-foot level and then again raises the drill stem to the datum level at average vertical speed and rotational speed. In the event of stuck drill stem, coke falls or other problems, stages 158 and 160 indicate that the operator can always intervene manually to straighten up the pilot hole with return to automatic. When main bed pilot ream is complete as at stage 162, the drill stem 40 and bit 50 are at the top of the coke drum 14, and the bit 50 may be changed to the main drill bit as at stage 164.

The operator then initializes all input selections for main bit cutting, i.e., selection of the bench cut parameters, and PROCEED is then actuated. As at stage 166, the program rotates the drill bit 50 at low speed as it lowers the drill stem clear to the bottom of the drum 14 thereby making sure that the pilot hole diameter is adequate for the main bed cutting tool. In the event that the drill bit encounters blockage during its downward movement, the program diverts to continuation D detecting as at flow stage 168 (FIG. 6) and manual intervention is required to clear the pilot hole as at stage 170. After clearance, the program recycles through automatic clearance check stage 166 and proceeds through continuation C and the continued flow of FIG. 7. Clearance check is completed at statement stage 172 whereupon certain maintenance checks may be carried out and the program is re-initialized to PROCEED with bottom cone cutting as indicated at flow stage 174. The bottom cone cut is carried out as the program raises the drill bit 50 fifteen feet at a low vertical speed and then lowers the drill stem fifteen feet, and the sequence is repeated. Check is made as to whether bottom cone cut is complete and, if required, manual intervention at stage 176 can effect necessary alterations. In the event that bottom cone cut is complete, the program moves to the mid-bed reaming procedure under automatic control as at stage 178. The program automatically raises the drill bit 50 to the mid point of the coke bed at a low vertical speed. The program then lowers the drill bit 50 for twenty seconds at low vertical speed, holds drill stem position for twenty seconds, and repeats the lowering and holding sequence until the 99-foot level has been reached. This entire sequence may be repeated as selected.

The program then proceeds to carry out the full bed ream whereupon drill bit 50 is raised from the 99-foot level upward to the datum at low vertical speed. A top ten feet reaming sequence is then carried out as at stage 180 wherein drill bit 50 is lowered ten feet at low vertical speed and raised ten feet at low vertical speed with repetition for a selected number of cycles until either cleared or operator manual intervention to move to the next sequence. The program then proceeds into the bench cutting procedure in accordance with the preselected STEP SIZE function of the input selector at the control console 126. Thus, excluding the bottom cone portion and the top ten feet of the coke bed, the remainder is divided into a series of steps, e.g., eight eight-foot steps which are successively cut in the automated procedure. The program assumes that the coke in the bottom of the drum is harder than the coke in the top of the drum so that the standard bench cutting cycle is repeated fewer times in the top than at the bottom.

Figure 8:
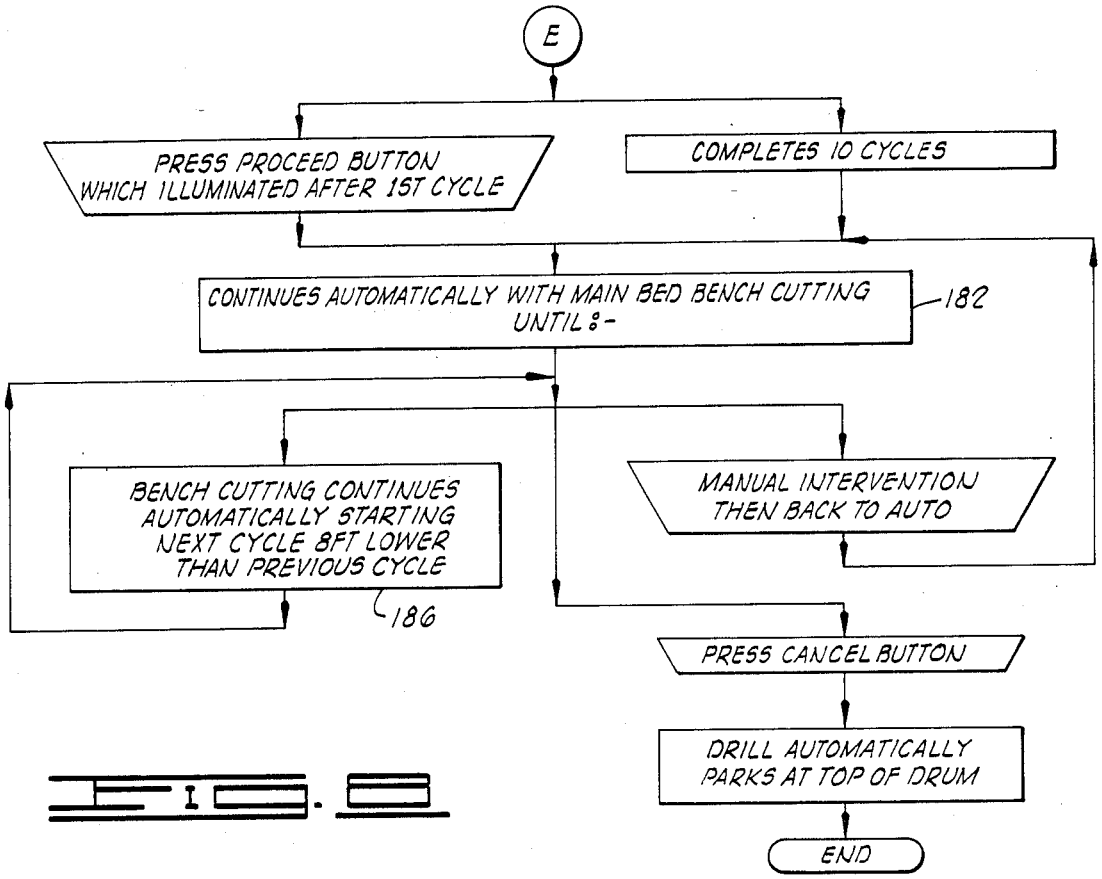

Referring now to FIG. 8, after the top ten-foot cut cycles have been run as at stage 180, the bench cutting procedures progress in stage 182 with multiple cycles of cutting passes at successive eight-foot levels. Each successive bench cutting cycle begins at a position eight feet lower than the previous cycle until the drill stem 40 has progressed downward to the 99-foot level whereupon the drill stem is again raised upward to begin clearing from the top down. Manual intervention is allowed for as the PROCEED button can be pressed at any time at stage 184 to move the main bit 50 downward to the next lower bench location (stage 186) as successively higher benches are cleared out. When drum 14 is entirely cleaned out, the program comes to an end and the drill stem 40 automatically returns to the top of the drum in idle position.

Figure 9:
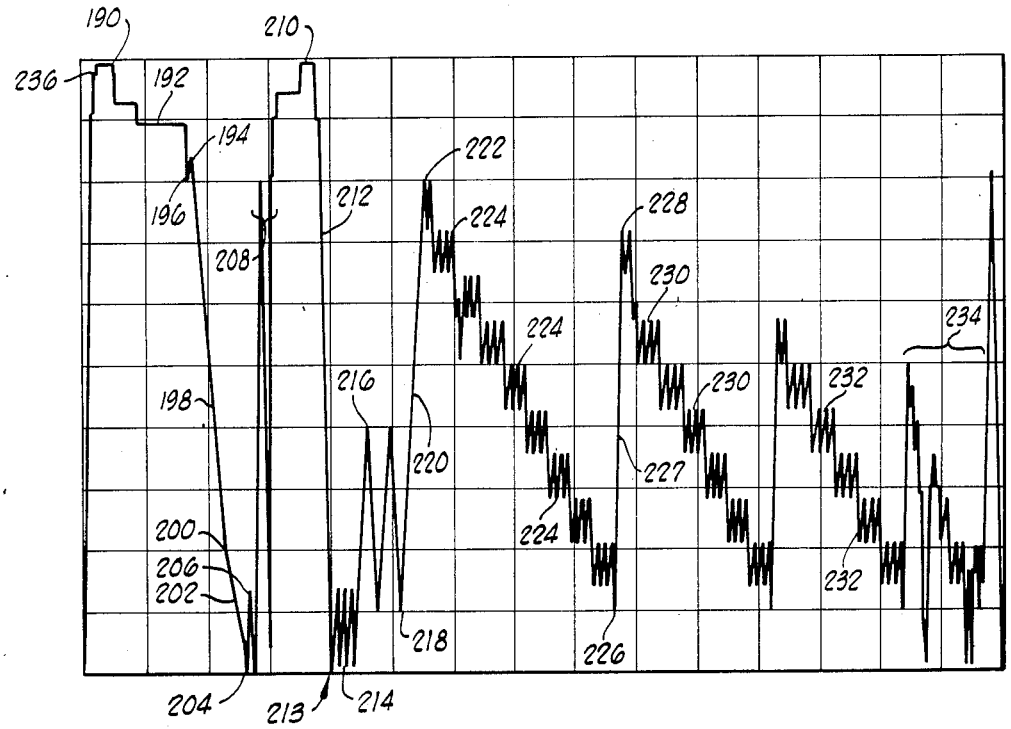
FIG. 9 depicts a section of strip chart of drill bit position versus time illustrating a complete de-coking process under control of the programmed logic controller.

FIG. 9 illustrates the sequence of movements through a complete drum clean-out process, a strip chart segment of time versus drill bit position. Thus, the clean-out process begins at position 190 with the bit outside the drum. The drill is lowered manually to a safe point inside the drum (192), whereupon the pilot bit is initialized and lowered to the datum level 196 and withdrawn 3 feet. Pilot drilling is commenced at 194 and pilot drilling proceeds at the increased rate of penetration along portion 198. The bit finds no resistance sufficient to cause automatic reduction of penetration rate but the 85-foot level change occurs at point 200 showing reduced rate along pilot path 202 to bottom breakthrough at the 109-foot level at graph point 204. Bottom cone reaming is then effected by the fifteen-foot cycle indicated by peak 206 and the pilot bit is drawn all the way up to the datum and all the way down and upward again as indicated by traverses 208. At this point, the pilot hole has been drilled, breakthrough has been achieved, bottom cone reaming in effected and axial hole reaming has been carried out.

In the period 210 such as equipment maintenance, oiling and bit change is effected whereupon the main bit is then lowered along traverse 212 from the datum all the way to bottom level at 109 feet thereby assuring clearance. At 213, a pause occurs in manual checking of equipment. The main bit is then oscillated over a fifteen-foot interval three times as indicated at 214, and the main bit is then traversed all the way up to mid-point as shown at 216 with repeated traverses between mid-point and the 99-foot level shown at point 218.

The Main bed cutting procedure continues as the main bit was brought upward along traverse 220 to the datum level at 222 for a plurality of vertical traverses cleaning out the top ten-foot portion of coke. The main bit was then moved through a plurality of successive, plural traverse, eight-foot bench cuts beginning at 224 and progressing downward to the 99-foot level at 226. The bench cutting cycle is again repeated moving upward along traverse 227 to a point 228 to effect a next successive cycle of bench cut traverses along the successively lower eight-foot work faces. The successive bench cuts as indicated at 230 may be overridden by operator's manual control as successive higher work faces are cleaned out to expose the bare interior wall of the coke drum.

Still a third series of bench cuts 232 are carried out automatically at successively lower work faces and the final irregular movements 234 indicative manual control as the operator performs a final clean-out operation and returns the drill stem to the top of the drum at 236, clean-out complete.

Minor adjustments to the speed and sequencing of the program are under the control of the operator during initialization at control console 126. Further operational alterations as deemed necessary from time to time are readily input to the program as required. In general, however, program sequencing as indicated in FIG. 9 provides proper operation and clean-out for a particular de-coking operation. The size of the coking equipment, drums and the like will of course be instrumental in setting certain operational functions of the program itself, and these may be readily effected by the skilled programmer.

The foregoing discloses a novel automatic control system for a hydro-blasting de-coking system that enables production of petroleum coke with greater margin of consistency and less fines production thereby to improve production efficiency. The system and automated process control carry out the de-coking operation while allowing manual intervention where required such that the total decoking operation is carried out in reduced time with greater operational safety and savings in equipment.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. A method of controlling de-coking of a petroleum coke drum with a hydro-blasting drill supported by a vertical hoist comprising the steps of:

entering predetermined operational control parameters comprising drill rotation speed, vertical elevation drill speed, vertical drill elevation position and drill tension into a programmable logic controller, sensing the vertical position of the hydro-blasting drill in the coke drum and generating an electrical drill elevation signal, sensing the tension being imposed by the vertical hoist on the hydro-blasting drill in the coke drum and generating an electrical drill tension signal, sensing the rotation speed of the hydro-blasting drill in the coke drum and generating an electrical drill rotation speed signal, coupling the electrical drill elevation signal, drill tension signal and drill rotation speed signal to said programmable logic controller, coupling the programmable logic controller to a power source for the vertical hoist and to a rotation drive source for the hydro-blasting drill, controlling the drill rotation speed, vertical elevation position and the tension imposed on the hydro-blasting drill during de-coking of the petroleum coke drum with electrical signal outputs from the controller.

2. The method of claim 1 further comprising the steps of:

establishing a vertical safety drill elevation limit within an upper portion of the drum for safe operation of the hydro-blasting drill, and generating an electrical signal output with the programmable logic controller to disable a source of hydro-blasting pressure being supplied to the hydro-blasting drill in response to said drill elevation signal indicating drill elevation above the vertical safety elevation limit.

3. The method of claim 2 further comprising the steps of:

monitoring the drill rotation speed with the programmable logic controller to detect a pre-determined decrease in drill rotation speed from the drill rotation speed entered as a control parameter into the programmable logic controller, and disabling the vertical hoist from the power source for a predetermined time interval to provide for recovery of drill rotation speed for the hydro-blasting drill, thereby preventing sticking of the hydro-blasting drill within the drum.

4. The method of claim 2 wherein initiation of the de-coking control method comprises the steps of:

lowering the hydro-blasting drill into the drum, monitoring the drill tension signal with the programmable logic controller to detect a coke-hit condition indicative of the hydro-blasting drill being lowered to an upper level of the coke within the drum, and initiating operation of the decoking control method with the programmable logic controller upon detection of the coke-hit condition.

5. The method of claim 4 further comprising the steps of:

calculating a petroleum coke yield for the drum being de-coked with the programmable logic controller upon detection of a coke-hit condition by the programmable logic controller.

* * * * *